US011639481B2

(12) United States Patent
Yuki et al.

(10) Patent No.: US 11,639,481 B2
(45) Date of Patent: May 2, 2023

(54) LUBRICANT ADDITIVE COMPOSITION

(71) Applicant: Evonik Operations GmbH, Essen (DE)

(72) Inventors: Tsuyoshi Yuki, Otsu (JP); Yasuo Arai, Kawasaki (JP); Tomohiro Matsuda, Tokyo (JP); Nobuhiro Kishida, Yokohama (JP)

(73) Assignee: Evonik Operations GmbH, Essen (DE)

( * ) Notice: Subject to any disclaimer, the term of this patent is extended or adjusted under 35 U.S.C. 154(b) by 0 days.

(21) Appl. No.: 17/812,212

(22) Filed: Jul. 13, 2022

(65) Prior Publication Data

US 2023/0025387 A1 Jan. 26, 2023

(30) Foreign Application Priority Data

Jul. 16, 2021 (EP) ..... 21185986

(51) Int. Cl.
*C10M 145/14* (2006.01)
*C10M 169/04* (2006.01)
*C10N 20/04* (2006.01)

(52) U.S. Cl.
CPC ..... *C10M 145/14* (2013.01); *C10M 169/041* (2013.01); *C10M 2203/003* (2013.01); *C10M 2209/084* (2013.01); *C10N 2020/04* (2013.01)

(58) Field of Classification Search
CPC ..... C10M 169/041; C10M 107/02; C10M 145/14; C10M 2205/0206; C10M 2209/084; C10M 2205/06; C08F 236/06; C08F 220/1812; C08F 2800/10; C10N 2020/04; C10N 2030/02; C10N 2020/019; C10N 2060/02
See application file for complete search history.

(56) References Cited

U.S. PATENT DOCUMENTS

| | | | | |
|---|---|---|---|---|
| 4,316,973 | A | 2/1982 | Kennedy | |
| 4,859,210 | A | 8/1989 | Franz et al. | |
| 6,255,261 | B1 | 7/2001 | Liesen et al. | |
| 6,599,864 | B1 | 7/2003 | Bertomeu | |
| 8,067,349 | B2 | 11/2011 | Stoehr et al. | |
| 8,143,202 | B2 | 3/2012 | Peer et al. | |
| 9,783,630 | B2 | 10/2017 | Stoehr et al. | |
| 10,920,164 | B2 | 2/2021 | Klein et al. | |
| 2008/0194443 | A1 | 8/2008 | Stohr et al. | |
| 2010/0190671 | A1 | 7/2010 | Stoehr et al. | |
| 2011/0306533 | A1 | 12/2011 | Eisenberg et al. | |
| 2011/0319305 | A1 | 12/2011 | Eisenberg et al. | |
| 2013/0219868 | A1* | 8/2013 | Alibert | C10M 145/02 508/459 |
| 2016/0097017 | A1 | 4/2016 | Eisenberg et al. | |
| 2019/0071615 | A1* | 3/2019 | Schöller | C08F 220/1804 |
| 2019/0177641 | A1 | 6/2019 | Klein et al. | |
| 2021/0047582 | A1 | 2/2021 | Kusumoto | |
| 2021/0179961 | A1* | 6/2021 | Nga | C10M 169/041 |
| 2021/0189281 | A1 | 6/2021 | Nguyen et al. | |

FOREIGN PATENT DOCUMENTS

| | | |
|---|---|---|
| EP | 0 668 342 | 8/1995 |
| EP | 0 776 959 | 6/1997 |
| EP | 1 029 029 | 8/2000 |
| GB | 2270317 | 3/1994 |
| JP | 63-175096 | 7/1988 |
| WO | 96/30421 | 10/1996 |
| WO | 97/18247 | 5/1997 |
| WO | 97/21788 | 6/1997 |
| WO | 97/47661 | 12/1997 |
| WO | 98/01478 | 1/1998 |
| WO | 98/40415 | 9/1998 |
| WO | 99/10387 | 4/1999 |
| WO | 99/20720 | 4/1999 |
| WO | 99/41332 | 8/1999 |
| WO | 00/08115 | 2/2000 |
| WO | 00/14179 | 3/2000 |
| WO | 00/14183 | 3/2000 |
| WO | 00/14187 | 3/2000 |
| WO | 00/14188 | 3/2000 |
| WO | 00/15736 | 3/2000 |
| WO | 01/18156 | 3/2001 |
| WO | 01/57166 | 8/2001 |
| WO | 2004/083169 | 9/2004 |
| WO | 2013/189951 | 12/2013 |

OTHER PUBLICATIONS

Extended European Search Report dated Dec. 23, 2021, in European Patent Application No. 21185986.3, 5 pages.
Mang et al., Cover copy of "Lubricants and Lubricant", Wiley-VCH, Weinheim 2001, 3 pages.
Mortier et al., Cover "Chemistry & Technology of Lubricants", Springer Science+Business Media, LLC, 1992, 3 pages.
Wang et al., "Controlled/"Living" Radical Polymerization. Atom Transfer Radical Polymerization in the Presence of Transition-Metal Complexes", Journal of American Chemical Society, vol. 117, pp. 5614-5615.
Wang et al., "Controlled/"Living" Radical Polymerization. Halogen Atom Transfer Radical Polymerization Promoted by a Cu(I)/Cu(II) Redox Process", Macromolecules, vol. 28, 1995, pp. 7901-7910.

(Continued)

*Primary Examiner* — Vishal V Vasisth

(74) *Attorney, Agent, or Firm* — Grüeberg and Myers, PLLC

(57) ABSTRACT

An additive composition contains a viscosity index improver and a pour point depressant. A process can be used for preparing the additive composition. The additive composition can be used as a lubricant additive in a lubricating oil formulation, and lubricating oil formulations can contain the additive composition.

20 Claims, No Drawings

(56) References Cited

OTHER PUBLICATIONS

U.S. Appl. No. 13/202,744, filed Aug. 22, 2011, 2011/0306533, Eisenberg et al.
U.S. Appl. No. 13/255,218, filed Sep. 7, 2011, 2011/0319305, Eisenberg et al.
U.S. Appl. No. 14/784,335, filed Oct. 14, 2015, 2016/0097017, Eisenberg et al.
U.S. Appl. No. 17/681,005, filed Feb. 25, 2022, Yuki et al.

* cited by examiner

LUBRICANT ADDITIVE COMPOSITION

CROSS-REFERENCE TO RELATED APPLICATIONS

This application claims priority to European Application No. 21185988.3, filed on Jul. 16, 2021, the content of which is hereby incorporated by reference in its entirety.

BACKGROUND OF THE INVENTION

Technical Field of the Invention

The invention relates to an additive composition and a process for preparing the same. The invention also relates to the use of said additive composition as a lubricant additive in a lubricating oil formulation and to lubricating oil formulations comprising said additive composition.

Description of Related Art

Pour point depressants (PPD) are additives that improve the low temperature performance of an oil by modifying the wax crystallization process. A wide variety of chemical types are currently available, and include poly alkyl methacrylates, styrenated polyesters, alkylated polystyrenes, ethylene-vinyl acetate, vinyl acetate-fumarate, styrene maleic anhydride, and alkylated naphthalenes. In particular polyalkyl methacrylates are commonly used as PPDs and contain linear $C_{16}$ or greater methacrylates that can be easily polymerized to obtain a polymer that can interact with the paraffinic substances in the base oil.

U.S. Pat. No. 8,143,202B2 describes a polyalkylmethacrylate with 60 to about 96 weight percent of a $C_{12}$-$C_{16}$ alkyl methacrylate and from about 4 to about 40 weight percent of a $C_{18}$-$C_{30}$ alkyl methacrylate and provide excellent low temperature properties to lubricating oils.

U.S. Pat. No. 6,255,261 describes poly(meth)acrylate copolymers comprising from about 5 to about 60 weight percent of a $C_{11}$-$C_{15}$ alkyl (meth) acrylate; and from about 40 to about 95 weight percent of a $C_{16}$-$C_{30}$ alkyl (meth) acrylate useful as PPDs.

The PPDs, like those described above, are therefore added to lubricant formulations for the purpose of improving low temperature properties of the oil, and for most formulations, an additional viscosity index improver (VII) is needed to improve the viscometric performance of the lubricant. Therefore, an additive composition comprising VII and PPD is preferred to reduce the number of additive components blended in the process of manufacturing the lubricating oils. However, an additive composition comprising VII and PPD can lead to problems of compatibility and consequently to some problems of storage stability.

Therefore, it would be interesting to develop an additive composition comprising VII and PPD which would have good storage properties over a long period of time and which could provide both improved low temperature performance, as well as higher viscosity index to the lubricating oil formulation to which it is added.

SUMMARY OF THE INVENTION

After thorough investigation, the inventors of the present invention have surprisingly found that the additive composition as described below solves the above technical problem as it provides a combination of good storage stability as an additive composition, high viscosity index and improved low-temperature performance in lubricant formulations.

Therefore, in a first aspect, the present invention relates to an additive composition as described below.

In a second aspect, the present invention relates to the method for preparing said additive composition.

In a third aspect, the present invention relates to the use of the additive composition as a lubricant additive in a lubricating oil formulation for improving the storage stability, the viscosity index and low temperature performance of said lubricating oil formulation.

In a fourth aspect, the present invention relates to a lubricating oil formulation comprising the additive composition as defined in the present invention.

The invention also includes the following embodiments:

1. An additive composition (A) comprising a viscosity index improver (V) and a pour point depressant (P), wherein the viscosity index improver (V) is a polymer having a weight average molecular weight (Mw) of 100,000 to 1,000,000 g/mol and obtainable by polymerizing a monomer composition comprising:

a) 10 to 30% by weight of one or more polybutadiene-based macromonomer a) having a number-average molecular weight of 500 to 10,000 g/mol, based on the total weight of the viscosity improver monomer composition, b) 50 to 70% by weight of methyl(meth)acrylate, butyl (meth)acrylate, one monomer having from 8 to 17 carbon atoms selected from a group consisting of styrene or a substituted styrene having an alkyl substituent in the side chain or a mixture thereof, based on the total weight of the viscosity improver monomer composition, c) 1 to 15% by weight of one monomer selected from linear or branched $C_7$-$C_{30}$ alkyl(meth)acrylates or a mixture thereof, based on the total weight of the viscosity improver monomer composition, wherein the pour point depressant (P) is a polymer having a weight average molecular weight (Mw) of 10,000 to 60,000 g/mol and obtainable by polymerizing a monomer composition comprising:

e) 20 to 35% by weight of one monomer selected from linear or branched $C_1$-$C_6$ alkyl(meth)acrylate or a mixture thereof, f) 20 to 75% by weight of one monomer selected from linear or branched $C_7$-$C_{15}$ alkyl(meth)acrylates, based on the total weight of the monomer composition, g) 5 to 80% by weight of at least one monomer selected from linear or branched $C_{16}$-$C_{24}$ alkyl(meth)acrylates, based on the total weight of the monomer composition, wherein the weight ratio of (V) to (P) is 99:1 to 80:20, based on the total solid polymer content of polymers (V) and (P) in the additive composition.

2. The additive composition (A) according to embodiment 1, wherein the viscosity index improver polymer (V) has a weight-average molecular weight from 100,000 to 600,000 g/mol.

3. The additive composition (A) according to embodiments 1 or 2, wherein the polybutadiene-based macromonomer a) has a number-average molecular weight of 1,000 to 6,000 g/mol, more preferably of 1,500 to 5,500 g/mol.

4. The additive composition (A) according to any one of embodiments 1 to 3, wherein the monomer e) is selected from methyl (meth)acrylate, butyl (meth)acrylate or a mixture thereof, preferably is methyl (meth)acrylate.

5. The additive composition (A) according to any one of embodiments 1 to 4, wherein the amount of monomer f) is 20 to 60% by weight, more preferably 25 to 55% by weight, based on the total weight of monomer composition of the pour point depressant (P).

6. The additive composition (A) according to any one of embodiments 1 to 5, wherein the amount of monomer g) is 20 to 50% by weight, more preferably 25 to 50% by weight, based on the total weight of monomer composition of the pour point depressant (P).

7. The additive composition (A) according to any one of embodiments 1 to 6, wherein the amounts of monomers e), f), and g) in the monomer composition of the pour point depressant (P) sum up to 95 to 100% by weight, based on the total weight of monomer composition of the pour point depressant (P).

8. The additive composition (A) according to any one of embodiments 1 to 7, wherein the amount of monomer b) is 55 to 70% by weight, based on the total weight of the monomer composition of the viscosity index improver V).

9. The additive composition (A) according to any one of embodiments 1 to 8, wherein the monomer c) is selected from a linear $C_{12-14}$ alkyl methacrylate, a linear $C_{16-18}$ alkyl methacrylate or a mixture thereof.

10. The additive composition (A) according to any one of embodiments 1 to 9, wherein the monomer composition of the viscosity index improver (V) further comprises 0 to 20% by weight, more preferably 0.1 to 20% by weight, even more preferably 0.1 to 15% by weight, most preferably 0.1 to 10% by weight of a monomer d) selected from the group consisting of (meth)acrylates of ether alcohols, aminoalkyl (meth)acrylates, aminoalkyl (meth)acrylamides or a mixture thereof.

11. The additive composition (A) according to anyone of embodiments 1 to 10, wherein the amounts of monomers a), b), c), and d) in the monomer composition of the viscosity index improver V) sum up to 95 to 100% by weight, based on the total weight of the viscosity index improver monomer composition.

12. The additive composition (A) according to any one of embodiments 1 to 11, wherein the viscosity index improver polymer (V) has a weight-average molecular weight (Mw) from 100,000 to 600,000 g/mol.

13. A method for preparing the additive composition (A) as defined in any one of embodiments 1 to 12, wherein the method comprises the steps of:

(x) preparing a viscosity index improver (V) by providing a monomer composition and initiating radical polymerization in the monomer composition to prepare the polymer (V), (y) preparing a pour point depressant (P) by providing a monomer composition and initiating radical polymerization in the monomer composition to prepare the polymer (P), (z) mixing the viscosity index improver (V) with the pour point depressant (P) to provide the additive composition (A).

14. A lubricating oil formulation comprising:

(i) one base oil or a mixture of base oils, and (ii) an additive composition (A) as defined in any one of embodiments 1 to 12.

15. Use of the additive composition (A) as defined in any one of embodiments 1 to 12 as a lubricant additive in a lubricating oil formulation for improving the storage stability, the viscosity index and low temperature performance of said lubricating oil formulation.

DETAILED DESCRIPTION OF THE INVENTION

Additive Composition of the Invention

In a first aspect, the invention relates to an additive composition (A) comprising a viscosity index improver (V) and a pour point depressant (P), wherein the viscosity index improver (V) is a polymer having a weight average molecular weight ($M_w$) of 100,000 to 1,000,000 g/mol and obtainable by polymerizing a monomer composition comprising:

a) 10 to 30% by weight of one or more polybutadiene-based macromonomer a) having a number-average molecular weight of 500 to 10,000 g/mol, based on the total weight of the viscosity improver monomer composition, b) 50 to 70% by weight of methyl(meth)acrylate, butyl (meth)acrylate, one monomer having from 8 to 17 carbon atoms selected from a group consisting of styrene or a substituted styrene having an alkyl substituent in the side chain or a mixture thereof, based on the total weight of the viscosity improver monomer composition, c) 1 to 15% by weight or one monomer selected from linear or branched $C_7$-$C_{30}$ alkyl(meth)acrylates or a mixture thereof, based on the total weight of the viscosity improver monomer composition, wherein the pour point depressant (P) is a polymer having a weight average molecular weight ($M_w$) of 10,000 to 60,000 g/mol and obtainable by polymerizing a monomer composition comprising:

e) 20 to 35% by weight of one monomer selected from linear or branched $C_1$-$C_6$ alkyl(meth)acrylate or a mixture thereof, f) 20 to 75% by weight of one monomer selected from linear or branched $C_7$-$C_{15}$ alkyl(meth)acrylates, based on the total weight of the monomer composition, g) 5 to 60% by weight of at least one monomer selected from linear or branched $C_{16}$-$C_{24}$ alkyl(meth)acrylates, based on the total weight of the monomer composition, wherein the weight ratio of (V) to (P) is 99:1 to 80:20, based on the total solid polymer content of polymers (V) and (P) in the additive composition.

Unless otherwise noted, the weight amounts of the monomers are given relative to the total amount of monomers used, namely, the total weight of the monomer composition to prepare the polymer.

Preferably, the viscosity index improver polymer (V) has a weight-average molecular weight ($M_w$) from 100,000 to 600,000 g/mol, more preferably from 100,000 to 500,000 g/mol, even more preferably from 100,000 to 400,000 g/mol.

Preferably, the polydispersity index (PDI) of the viscosity index improver (V) according to the invention is in the range from 1.0 to 6.0, more preferably from 2.0 to 5.5, even more preferably from 3.0 to 5.0. The polydispersity index is defined as the ratio of weight-average molecular weight to number-average molecular weight ($M_w/M_n$).

Preferably, the pour point depressant polymer (P) has a weight average molecular weight ($M_w$) of 15,000 to 60,000 g/mol, more preferably of 15,000 to 50,000 g/mol.

Preferably, the polydispersity index (PDI) of the pour point depressant polymer (P) according to the invention is in the range from 1.0 to 5.0, more preferably from 1.5 to 4.5, even more preferably from 2.0 to 3.0. The polydispersity index is defined as the ratio of weight-average molecular weight to number-average molecular weight ($M_w/M_n$).

In the present invention, the weight-average molecular weights ($M_w$) of the polymers (pour point depressant (P) and viscosity index improver (V)) are determined by gel permeation chromatography (GPC) using polymethylmethacrylate calibration standards using the following measurement conditions:

Eluent: tetrahydrofuran (THF)

Operation temperature: 40° C.

Column set: the column set consists of one pre-column (PSS-SDV 100 Å 10 μm 8.0×50 mm), and three columns (2×PSS-SDV Linear XL 10 μm 8.0×300 mm, 1×PSS-SDV 100 Å 10 μm 8.0×300 mm), all columns with an average particle size of 10 μm (PSS Standards Service GmbH, Mainz, Germany)

Flow rate: 1 mL/min

Injected volume: 100 μL

Instrument: Shodex GPC101 consisting of an autosampler, pump and column oven

Detection device: a refractive index detector from Shodex.

The term "(meth)acrylic acid" in the context of this invention refers to acrylic acid, methacrylic acid and mixtures or acrylic acid and methacrylic acid; methacrylic acid being preferred. The term "(meth)acrylate" refers to esters of acrylic acid, esters of methacrylic acid or mixtures or esters or acrylic acid and methacrylic acid; esters of methacrylic acid being preferred.

Preferably, the additive composition (A) contains at least 25% by weight of solid polymer content, based on the total weight of the polymers (P) and (V) in the additive composition (A).

Preferably, the amount of monomer e) is 25 to 30% by weight, based on the total weight of the monomer composition of the pour point depressant (P). The monomer e) is selected from methyl(meth)acrylate, butyl(meth)acrylate or a mixture thereof, preferably is methyl (meth)acrylate.

Preferably, the amount of monomer f) is 20 to 60% by weight, more preferably 25 to 55% by weight, based on the total weight of the monomer composition of the pour point depressant (P).

Preferably, the amount of monomer g) is 20 to 50% by weight, more preferably 25 to 50% by weight, based on the total weight of the monomer composition of the pour point depressant (P).

Preferably, the amounts of monomers e), f), and g) in the monomer composition of the pour point depressant (P) sum up to 95 to 100% by weight, preferably sum up to 100%, based on the total weight of monomer composition of the pour point depressant (P).

Preferably, the amount of monomer a) is 15 to 30% by weight, more preferably 15 to 29% by weight, based on the total weight of the monomer composition of the viscosity index improver (V).

Preferably, the amount of monomer b) is 55 to 70% by weight, based on the total weight of the monomer composition of the viscosity index improver (V).

Monomers b) according to the invention are selected from methyl(meth)acrylate, butyl(meth)acrylate, one monomer having from 8 to 17 carbon atoms selected from a group consisting of styrene or a substituted styrene having an alkyl substituent in the side chain or a mixture thereof. Suitable styrene monomers having from 8 to 17 carbon atoms are selected from the group consisting of styrene, substituted styrenes having an alkyl substituent in the side chain, for example alpha-methylstyrene and alpha-ethylstyrene, substituted styrenes having an alkyl substituent on the ring, such as vinyltoluene and para-methylstyrene, halogenated styrenes, for example monochlorostyrenes, dichlorostyrenes, tribromostyrenes and tetrabromostyrenes, nitrostyrene; styrene being preferred.

Preferably, the monomer c) is selected from a linear $C_{12-14}$ alkyl methacrylate, a linear $C_{16-18}$ alkyl methacrylate or a mixture thereof, more preferably a mixture thereof.

Preferably, the monomer composition of the viscosity index improver (V) further comprises 0 to 20% by weight, more preferably 0.1 to 20% by weight, even more preferably 0.1 to 15% by weight, most preferably 0.1 to 10% by weight of monomer d) selected from the group consisting of (meth) acrylates of ether alcohols, aminoalkyl (meth)acrylates, aminoalkyl (meth)acrylamides or a mixture thereof.

Preferably, the amounts of monomers a), b), c), and d) in the monomer composition of the viscosity index improver (V) sum up to 95 to 100% by weight, preferably sum up to 100%, based on the total weight of the viscosity index improver monomer composition.

The polybutadiene-based macromonomers a) of the invention are esters of (meth)acrylic acid, which are either the reaction product of one ester of (meth)acrylic acid with one hydroxylated hydrogenated polybutadiene (by transesterification), or the reaction product of one (meth)acrylic acid with one hydroxylated hydrogenated polybutadiene (by direct esterification).

A polymer (V) in the context of this invention comprises a first polymer, which is also referred to as backbone or main chain, and a multitude of further polymers which are referred to as side chains and are bonded covalently to the backbone. In the present case, the backbone of the polymer is formed by the interlinked unsaturated groups of the mentioned (meth)acrylic acid esters. The alkyl groups and the hydrogenated polybutadiene chains of the (meth)acrylic esters form the side chains of the polymer. The reaction product of one ester of (meth)acrylic acid and one hydroxylated hydrogenated polybutadiene or the reaction product of one (meth)acrylic acid and one hydroxylated hydrogenated polybutadiene corresponds to monomer a) and is also referred in the present invention as macromonomer or polybutadiene-based macromonomer a).

The viscosity index improver polymer (V) according to the invention can be characterized on the basis of its molar degree of branching ("f-branch"). The molar degree of branching refers to the percentage in mol % of macromonomer (monomer a)) used, based on the total molar amount of all the monomers in the monomer composition. The molar amount of the macromonomer used is calculated on the basis of the number-average molecular weight $M_n$ of the macromonomer. The calculation of the molar degree of branching is described in detail in WO 2007/003238 A1, especially on pages 13 and 14, to which reference is made here explicitly.

Preferably, the polymers have a molar degree of branching $f_{branch}$ of 0.1 to 5 mol %, more preferably 0.5 to 4 mol % and most preferably 1.0 to 2.5 mol %.

Macromonomers a)

According to the invention, the monomer composition of the polymer (V) comprises as monomer a) from 10 to 30% by weight, preferably from 10 to 29% by weight, more preferably from 15 to 29% by weight, of a polybutadiene-based macromonomer having a number-average molecular weight ($M_n$) of 500 to 10,000 g/mol, based on the total weight or the monomer composition.

Preferably, the polybutadiene-based macromonomer a) for use in accordance with the invention has a number-average molecular weight ($M_n$) of 1,000 to 6,000 g/mol, more preferably from 1,500 to 5,500 g/mol.

The number-average molecular weight ($M_n$) of the macromonomer is determined by gel permeation chromatography (GPC) using polybutadiene calibration standards (PSS Standards Service GmbH, Mainz, Germany) according to DIN 55672-1 using the following measurement conditions:

Eluent: tetrahydrofuran (THF)

Operation temperature: 35° C.

Column set: the column set consists of one pre-column (PSS-SDV; 10μ; 8×50 mm); four PSS-SDV columns with a size of 300×8 mm and an average particle size of 10 μm (SDV-LXL, SDV-LinL, 2 columns SDV 100 Å (PSS Standards Service GmbH, Mainz, Germany)); and one solvent-peak separation column with a size of 8×100 mm (KF-800D from the company Shodex)

Flow rate: 1 mL/min

Injected volume: 100 μL

Instrument: Agilent 1100 series consisting of an autosampler, pump and column oven Detection device: a refractive index detector from Agilent 1100 series Preferably, the hydroxylated hydrogenated polybutadienes have a hydrogenation level of at least 99%. An alternative measure of the hydrogenation level which can be determined on the polymer of the invention is the iodine number. The iodine number refers to the number of grams of iodine which can be added onto 100 g of polymer. Preferably, the polymer of the invention has an iodine number of not more than 5 g of iodine per 100 g of polymer. The iodine number is determined by the Wijs method according to DIN 53241-1:1995-05.

Preferred hydroxylated hydrogenated polybutadienes can be obtained according to GB 2270317.

As used herein, the term "hydroxylated hydrogenated polybutadiene" refers to a hydrogenated polybutadiene that comprises one or more hydroxyl groups. The hydroxylated hydrogenated polybutadiene may further comprise additional structural units, such as polyether groups derived from the addition of alkylene oxides to a polybutadiene or a maleic anhydride group derived from the addition of maleic anhydride to a polybutadiene. These additional structural units may be introduced into the polybutadiene when the polybutadiene is functionalized with hydroxyl groups.

Preference is given to monohydroxylated hydrogenated polybutadienes. More preferably, the hydroxylated hydrogenated polybutadiene is a hydroxyethyl- or hydroxypropyl-terminated hydrogenated polybutadiene. Particular preference is given to hydroxypropyl-terminated polybutadienes.

These monohydroxylated hydrogenated polybutadienes can be prepared by first converting butadiene monomers by anionic polymerization to polybutadiene. Subsequently, by reaction of the polybutadiene monomers with an alkylene oxide, such as ethylene oxide or propylene oxide, a hydroxy-functionalized polybutadiene can be prepared. The polybutadiene may also be reacted with more than one alkylene oxide units, resulting in a polyether-polybutadiene block copolymer having a terminal hydroxyl group. The hydroxylated polybutadiene can be hydrogenated in the presence of a suitable transition metal catalyst.

These monohydroxylated hydrogenated polybutadienes can also be selected from products obtained by hydroboration of (co)polymers of having a terminal double bond (e.g. as described in U.S. Pat. No. 4,316,973): maleic anhydride-ene-amino alcohol adducts obtained by an ene reaction between a (co)polymer having a terminal double bond and maleic anhydride with an amino alcohol; and products obtained by hydroformylation of a (co)polymer having a terminal double bond, followed by hydrogenation (e.g. as described in JP Publication No. S63-175096).

The macromonomers a) for use in accordance with the invention can be prepared by transesterification of alkyl (meth)acrylates. Reaction of the alkyl(meth)acrylate with the hydroxylated hydrogenated polybutadiene forms the ester of the invention. Preference is given to using methyl (meth)acrylate or ethyl(meth)acrylate as reactant.

This transesterification is widely known. For example, it is possible for this purpose to use a heterogeneous catalyst system, such as lithium hydroxide/calcium oxide mixture (LiOH/CaO), pure lithium hydroxide (LiOH), lithium methoxide (LiOMe) or sodium methoxide (NaOMe) or a homogeneous catalyst system such as isopropyl titanate ($Ti(OiPr)_4$) or dioctyltin oxide ($Sn(OCt)_2O$). The reaction is an equilibrium reaction. Therefore, the low molecular weight alcohol released is typically removed, for example by distillation.

In addition, the macromonomers can be obtained by a direct esterification proceeding, for example, from (meth) acrylic acid or (meth)acrylic anhydride, preferably under acidic catalysis by p-toluenesulfonic acid or methanesulfonic acid, or from free methacrylic acid by the DCC method (dicyclohexylcarbodiimide).

Furthermore, the present hydroxylated hydrogenated polybutadiene can be converted to an ester by reaction with an acid chloride such as (meth)acryloyl chloride.

Preferably, in the above-detailed preparations of the esters of the invention, polymerization inhibitors are used, for example the 4-hydroxy-2,2,6,6-tetramethylpiperidinooxyl radical and/or hydroquinone monomethyl ether.

Monomers c)

Regarding the monomers c), the term "$C_{7-30}$ alkyl(meth) acrylates" refers to esters of (meth)acrylic acid with linear or branched alkyl chain having 7 to 30 carbon atoms. The term encompasses individual (meth)acrylic esters with an alcohol of a particular length, and likewise mixtures of (meth)acrylic esters with alcohols of different lengths.

Suitable $C_{7-30}$ alkyl(meth)acrylates include, for example, 2-butyloctyl(meth)acrylate, 2-hexyloctyl(meth)acrylate, decyl(meth)acrylate, 2-butyldecyl(meth)acrylate, 2-hexyldecyl(meth)acrylate, 2-octyldecyl(meth)acrylate, undecyl (meth)acrylate, 5-methylundecyl(meth)acrylate, dodecyl (meth)acrylate, 2-methyldodecyl(meth)acrylate, 2-hexyldodecyl(meth)acrylate, 2-octyldodecyl (meth)acrylate, tridecyl(meth)acrylate, 5-methyltridecyl(meth)acrylate, tetradecyl(meth)acrylate, 2-decyltetradecyl(meth)acrylate, pentadecyl(meth)acrylate, hexadecyl(meth)acrylate, 2-methylhexadecyl(meth)acrylate, 2-dodecylhexadecyl (meth)acrylate, heptadecyl(meth)acrylate, 5-isopropylheptadecyl(meth)acrylate, 4-tert-butyloctadecyl(meth)acrylate, 5-ethyloctadecyl(meth)acrylate, 3-isopropyloctadecyl (meth)acrylate, octadecyl(meth)acrylate, 2-decyloctadecyl (meth)acrylate, 2-tetradecyloctadecyl(meth)acrylate, nonadecyl(meth)acrylate, eicosyl(meth)acrylate, cetyleicosyl (meth)acrylate, stearyleicosyl(meth)acrylate, docosyl(meth) acrylate, eicosyltetratriacontyl(meth)acrylate, 2-decyltetradecyl(meth)acrylate, 2-decyloctadecyl(meth)acrylate, 2-dodecyl-hexadecyl(meth)acrylate, 1,2-octyl-1-dodecyl (meth)acrylate, 2-tetradecylocadecyl(meth)acrylate, 1,2-tetradecyl-octadecyl(meth)acrylate and 2-hexadecyl-eicosyl (meth)acrylate, n-tetracosyl(meth)acrylate, n-triacontyl (meth)acrylate and/or n-hexatriacontyl(meth)acrylate.

The term "$C_{12-14}$ alkyl(meth)acrylates" refers to esters of (meth)acrylic acid and linear or branched alcohols having 12 to 14 carbon atoms. The term encompasses individual (meth)acrylic esters with an alcohol of a particular length, and likewise mixtures of (meth)acrylic esters with alcohols of different lengths. Suitable $C_{12-14}$ alkyl(meth)acrylates include, for example, dodecyl methacrylate, 2-methyldodecyl methacrylate, tridecyl methacrylate, 5-methyltridecyl methacrylate and/or tetradecyl methacrylate.

Likewise, the $C_{16-18}$ alkyl(meth)acrylates include, for example, may also independently be selected from the group consisting of hexadecyl (meth)acrylate, 2-methylhexadecyl (meth)acrylate, heptadecyl (meth)acrylate, 5-isopropylheptadecyl (meth)acrylate, 4-tert-butyloctadecyl (meth)acrylate, 5-ethyloctadecyl (meth)acrylate, 3-isopropyloctadecyl (meth)acrylate, octadecyl (meth)acrylate, nonadecyl (meth) acrylate, eicosyl (meth)acrylate, cetyleicosyl (meth)acrylate, stearyleicosyl (meth)acrylate, docosyl (meth)acrylate, behenyl (meth)acrylate, eicosyltetratriacontyl (meth)acrylate, cycloalkyl (meth)acrylates, 2,4,5-tri-t-butyl-3-vinylcyclohexyl (meth)acrylate, and 2,3,4,5-tetra-t-butylcyclohexyl (meth)acrylate. Particularly preferred $C_{16-18}$ alkyl(meth) acrylates is stearyleicosyl (meth)acrylate.

Particularly preferred monomers c) are (meth)acrylic esters of a linear $C_{12-14}$ alcohol mixture ($C_{12-14}$ alkyl methacrylate), (meth)acrylic esters of a linear $C_{16-18}$ alcohol mixture ($C_{16-18}$ alkyl methacrylate) or a mixture thereof.

Monomers e)

The monomer composition of the pour point depressant (P) according to the present invention comprises 0 to 35% by weight of one monomer selected from linear or branched $C_1$-$C_6$ alkyl(meth)acrylate or a mixture thereof.

Examples of the $C_1$ to $C_6$ alkyl (meth)acrylate monomers, where the linear or branched alkyl group contains from 1 to 8 carbon atoms, are methyl methacrylate (MMA), methyl and ethyl acrylate, propyl methacrylate, butyl methacrylate (BMA) and acrylate (BA), isobutyl methacrylate (IBMA), hexyl and cyclohexyl methacrylate, cyclohexyl acrylate and combinations thereof. Most preferred $C_1$ to $C_6$ alkyl (meth) acrylate monomer is methyl methacrylate.

Monomers f)

The monomer composition of the pour point depressant polymer (P) according to the present invention comprises 20 to 95% by weight, preferably 25 to 95% by weight, of one monomer selected from linear or branched $C_7$-$C_{15}$ alkyl (meth)acrylates, based on the total weight of the monomer composition. Preferred $C_7$ to $C_{15}$ alkyl (meth)acrylates are $C_{12}$ to $C_{14}$ alkyl (meth)acrylates.

Examples of the $C_7$ to $C_{15}$ alkyl (meth)acrylate monomers, where the linear or branched alkyl group contains from 7 to 15 carbon atoms, are 2-ethylhexyl acrylate (EHA), 2-ethylhexyl methacrylate, octyl methacrylate, nonyl methacrylate, decyl methacrylate, isodecyl methacrylate (IDMA, based on branched (C10) alkyl isomer mixture), undecyl methacrylate, dodecyl methacrylate (also known as lauryl methacrylate), tridecyl methacrylate, tetradecyl methacrylate (also known as myristyl methacrylate), pentadecyl methacrylate and mixtures thereof. More preferred $C_7$ to $C_{15}$ alkyl (meth)acrylate monomers are dodecyl-pentadecyl methacrylate (DPMA); a mixture of linear and branched isomers of dodecyl, tridecyl, tetradecyl and pentadecyl methacrylates; decyl-octyl methacrylate (DOMA), a mixture of decyl and octyl methacrylates; nonyl-undecyl methacrylate (NUMA), a mixture of nonyl, decyl and undecyl methacrylates; and lauryl-myristyl methacrylate (LMA), a mixture of dodecyl and tetradecyl methacrylates. Preferred $C_7$ to $C_{15}$ alkyl (meth)acrylate is lauryl-myristyl methacrylate (LMA).

Monomers g)

The monomer composition of the pour point depressant polymer according to the invention comprises 5 to 60% by weight, preferably 5 to 50% by weight, of at least one monomer selected from linear or branched $C_{16}$-$C_{24}$ alkyl (meth)acrylates, based on the total weight of the monomer composition.

Examples of the $C_{16}$ to $C_{24}$ alkyl (meth)acrylate monomers, where the linear or branched alkyl group contains from 16 to 24 carbon atoms, are hexadecyl methacrylate (also known as cetyl methacrylate), heptadecyl methacrylate, octadecyl methacrylate (also known as stearyl methacrylate), nonadecyl methacrylate, eicosyl methacrylate, behenyl methacrylate and mixtures thereof. More preferred $C_{16}$ to $C_{24}$ alkyl (meth)acrylate monomers are: cetyl-eicosyl methacrylate (CEMA), a mixture of hexadecyl, octadecyl, and eicosyl methacrylate; cetyl-stearyl methacrylate (SMA), or a mixture of hexadecyl and octadecyl methacrylate. Most preferred $C_{16}$ to $C_{24}$ alkyl (meth)acrylates are selected from the group consisting of cetyl-eicosyl methacrylate (CEMA), cetyl-stearyl methacrylate (SMA) or a mixture thereof.

Method for the Preparation of the Additive Composition According to the Invention The present invention also relates to a method for preparing the additive composition (A) according to the present invention, wherein the method comprises the steps of:

(x) preparing a viscosity index improver (V) by providing a monomer composition as defined in the above section "Additive composition of the invention" and initiating radical polymerization in the monomer composition to prepare the polymer (V), (y) preparing a pour point depressant (P) by providing a monomer composition as defined in the above section "Additive composition of the invention" and initiating radical polymerization in the monomer composition to prepare the polymer (P), (z) mixing the viscosity index improver polymer (V) with the pour point depressant polymer (P) to provide the additive composition (A) according to the present invention.

Standard free-radical polymerization is detailed, inter alia, in Ullmann's Encyclopedia of Industrial Chemistry, Sixth Edition. In general, a polymerization initiator and optionally a chain transfer agent are used for this purpose.

The ATRP method is known per se. It is assumed that this is a "living" free-radical polymerization, but no restriction is intended by the description of the mechanism. In these processes, a transition metal compound is reacted with a compound having a transferable atom group. This involves transfer of the transferable atom group to the transition metal compound, as a result of which the metal is oxidized. This reaction forms a free radical which adds onto ethylenic groups. However, the transfer of the atom group to the transition metal compound is reversible, and so the atom group is transferred back to the growing polymer chain, which results in formation of a controlled polymerization system. It is accordingly possible to control the formation of the polymer, the molecular weight and the molecular weight distribution.

This reaction regime is described, for example, by J.-S. Wang, et al., J. Am. Chem. Soc, vol. 117. p. 5614-5615 (1995), by Matyjaszewski, Macromolecules, vol. 28, p. 7901-7910 (1995). In addition, patent applications WO 96/30421, WO 97/47661, WO 97/18247, WO 98/40415 and WO 99/10387 disclose variants of the above-elucidated ATRP. In addition, the polymers of the invention can also be obtained for example via RAFT method. This method is described in detail, for example, in WO 98/01478 and WO 2004/083169.

The polymerization can be conducted under standard pressure, reduced pressure or elevated pressure. The polymerization temperature is also uncritical. However, it is in general, in the range from −20 to 200° C., preferably 50 to 150° C. and more preferably 80 to 130° C.

Preferably, the oil used for diluting the monomer composition for polymer (V) or polymer (P) is an API Group I, II, III, IV or V oil, or a mixture thereof. Preferably, a Group III oil or a mixture thereof is used to dilute the monomer composition.

Preferably, the polymerization step for polymer (V) or polymer (P) comprises the addition of a radical initiator.

Suitable radical initiators are, for example, azo initiators, such as azobis-isobutyronitrile (AIBN), 2,2'-azobis(2-methylbutyronitrile) (AMBN) and 1,1-azobiscyclohexanecarbonitrile, and peroxy compounds such as methyl ethyl ketone peroxide, acetylacetone peroxide, dilauryl peroxide, tert-butyl peroxy-2-ethylhexanoate, ketone peroxide, tert-butyl peroctoate, methyl isobutyl ketone peroxide, cyclohexanone peroxide, dibenzoyl peroxide, tert-butyl peroxybenzoate, tert-butyl peroxyisopropylcarbonate, 2,5-bis(2-ethylhexanoylperoxy)-2,5-dimethylhexane, tert-butyl peroxy-2-ethylhexanoate, tert-butyl peroxy-3,5,5-trimethylhexanoate, dicumyl peroxide, 1,1-bis(tert-butylperoxy)cyclohexane, 1,1-bis(tert-butylperoxy)-3,3,5-trimethylcyclohexane, cumyl hydroperoxide, tert-butyl hydroperoxide and bis(4-tert-butylcyclohexyl) peroxydicarbonate.

Preferably, the radical initiator is selected from the group consisting of 2,2'-azobis(2-methylbutyronitrile), 2,2-bis (tert-butylperoxy)butane, tert-butylperoxy 2-ethylhexanoate, 1,1-di-tert-butylperoxy-3,3,5-trimethylcyclohexan, tert-butyl peroxybenzoate and tert-butylperoxy-3,5,5-trimethylhexanoat. Particularly preferred initiators are tert-butylperoxy 2-ethylhexanoate and 2,2-bis(tert-butylperoxy) butane.

Preferably, the total amount of radical initiator relative to the total weight of the monomer composition of polymer (V) or polymer (P) is 0.01 to 5% by weight, more preferably 0.02 to 1% by weight, most preferably 0.05 to 0.5% by weight.

The total amount of radical initiator may be added in a single step or the radical initiator may be added in several steps over the course of the polymerization reaction. Preferably, the radical initiator is added in several steps. For example, a part of the radical initiator may be added to initiate radical polymerization and a second part of the radical initiator may be added 0.5 to 3.5 hours after the initial dosage.

Preferably, step (y) also comprises the addition of a chain transfer agent. Suitable chain transfer agents are especially oil-soluble mercaptans, for example n-dodecyl mercaptan or 2-mercaptoethanol, or else chain transfer agents from the class of the terpenes, for example terpinolene. Particularly preferred is the addition of n-dodecyl mercaptan.

Preferably, the total reaction time of the radical polymerization is 2 to 10 hours, more preferably 3 to 9 hours.

After completion of the radical polymerization, the obtained polymers (P) and (V) are mixed to provide the additive composition (A) according to the present invention. The additive composition (A) is then preferably further diluted with the above-mentioned oil to the desired viscosity. Preferably, the additive composition (A) contains at least 25% by weight of solid polymer content, based on the total weight of the polymers (P) and (V) in the additive composition (A).

Use of the Additive Composition According to the Invention

The present invention also relates to the use of the additive composition as a lubricant additive in a lubricating oil formulation for improving the storage stability, the viscosity index and low temperature performance of said lubricating oil formulation.

The present invention also relates to a method for improving the storage stability, the viscosity index and low temperature performance of a lubricating oil formulation by incorporating the additive composition (A) according to the present invention as a lubricant additive in said lubricating oil formulation.

The additive composition (A) of the invention can thereby be used as a lubricant additive in a lubricating oil formulation, resulting in both improved compatibility and storage stability, but also improved low temperature performance and improved viscosity index. This approach may therefore avoid any incompatibilities between different package components, dispersing agents, and other additives in the lubricant formulation, as the additive composition of the present invention already combines two additive lubricant polymers, namely, a VII and a PPD, showing very good compatibility and viscometric performance.

Lubricating Oil Formulation Comprising the Additive Composition According to the Invention The invention also relates to a lubricating oil formulation comprising (i) one base oil or a mixture of base oils; and (ii) the additive composition (A) according to the present invention.

The lubricating oil formulation may also comprise optionally further additives (iii) as described below.

The concentration (also called treat rate) of the additive composition (A) according to the invention in the lubricating oil formulation can vary in broad ranges, such as from 0.1 to 99.5% by weight, or from 0.5 to 99.5% by weight. Preferably, the amount of the one or more base oil (component i)) is 0.5 to 80% by weight, more preferably 50 to 80% by weight and the amount of additive composition (component ii)) is preferably 20 to 99.5% by weight, more preferably 20 to 50% by weight, based on the total weight of the lubricating oil formulation, respectively.

Preferably, the amounts of (i) and (i) sum up from 95 to 100% by weight.

The additive compositions (A) of the present invention and the lubricating oil formulations comprising the additive compositions according to the invention are favorably used for driving system lubricating oils (such as manual transmission fluids, differential gear oils, automatic transmission fluids and belt-continuously variable transmission fluids, axle fluid formulations, dual clutch transmission fluids, and dedicated hybrid transmission fluids), hydraulic oils (such as hydraulic oils for machinery, power steering oils, shock absorber oils), engine oils (for gasoline engines and for diesel engines) and industrial oil formulations (such as wind turbine).

If the lubricating oil formulation according to the present invention is used as an engine oil, it preferably comprises from 0.5% by weight to 10% by weight, more preferably from 0.5% by weight to 8% by weight of the additive composition according to the invention, based on the total weight of the lubricant composition, leading to a kinematic viscosity at 100° C. being in the range from 4 $mm^2/s$ to 10 $mm^2/s$ according to ASTM D445.

If the lubricating oil formulation of the present invention is used as an automotive gear oil, it preferably comprises from 0.5% by weight to 10% by weight, more preferably from 0.5% by weight to 8% by weight of the additive composition according to the invention, based on the total weight of the lubricant composition, leading to a kinematic viscosity at 100° C. being in the range from 2 $mm^2/s$ to 15 $mm^2/s$ according to ASTM D445.

If the lubricant composition of the present invention is used as an automatic transmission oil, it preferably comprises from 0.5% by weight to 10% by weight, more preferably from 0.5% by weight to 8% by weight of the additive composition according to the invention, based on the total weight of the lubricant composition, leading to a kinematic viscosity at 100° C. being in the range from 2 $mm^2/s$ to 6 $mm^2/s$ according to ASTM D445.

The kinematic viscosity may be measured according to ASTM D445. Preferably, the kinematic viscosity is measured at a temperature of 100° C. and 40° C.

The base oil (i) to be used in the lubricating oil formulation preferably comprises an oil of lubricating viscosity. Such oils include natural and synthetic oils, oil derived from hydrocracking, hydrogenation, and hydro-finishing, unrefined, refined, re-refined oils or mixtures thereof.

The base oil may also be defined as specified by the American Petroleum Institute (API) (see April 2008 version of "Appendix E-API Base Oil Interchangeability Guidelines for Passenger Car Motor Oils and Diesel Engine Oils", section 1.3 Sub-heading 1.3. "Base Stock Categories").

The API currently defines five groups of lubricant base stocks (API 1509, Annex E—API Base Oil Interchangeability Guidelines for Passenger Car Motor Oils and Diesel Engine Oils, September 2011). Groups I, II and III are mineral oils which are classified by the amount of saturates and sulfur they contain and by their viscosity indices; Group IV are polyalphaolefins; and Group V are all others, including e.g. ester oils. The Table 1 below illustrates these API classifications.

TABLE 1

| Group | Saturates | Sulphur content | Viscosity Index (VI) |
|---|---|---|---|
| I | <90% | >0.03% | 80-120 |
| II | at least 90% | not more than 0.03% | 80-120 |
| III | at least 90% | not more than 0.03% | at least 120 |
| IV | All polyalphaolefins (PAOs) | | |
| V | All others not included in Groups I, II, III or IV (e.g. ester oils) | | |

The kinematic viscosity at 100° C. ($KV_{100}$) of appropriate base oils used to prepare a lubricant composition in accordance with the present invention is preferably in the range of 1 $mm^2/s$ to 10 $mm^2/s$, more preferably in the range of 1 $mm^2/s$ to 8 $mm^2/s$, even more preferably of 1 $mm^2/s$ to 5 $mm^2/s$, according to ASTM D445.

Further base oils which can be used in accordance with the present invention are Group II to III Fischer-Tropsch derived base oils.

Fischer-Tropsch derived base oils are known in the art. By the term "Fischer-Tropsch derived" is meant that a base oil is, or is derived from, a synthesis product of a Fischer-Tropsch process. A Fischer-Tropsch derived base oil may also be referred to as a GTL (Gas-To-Liquids) base oil. Suitable Fischer-Tropsch derived base oils that may be conveniently used as the base oil in the lubricating composition of the present invention are those as for example disclosed in EP0776959, EP0668342, WO97/21788, WO00/15736, WO00/14188, WO00/14187, WO00/14183, WO00/14179, WO00/08115, WO099/41332, EP1029029, WO01/18156, WO01/57166 and WO2013/189951.

Especially for transmission oil formulations, base oils of API Group III and mixtures of different Group III oils are used. In a preferred embodiment, the one or more base oil (i) is an API Group III base oil or a mixture of API Group III base oils.

The lubricating oil formulations according to the present invention are further characterized by their low kinematic viscosity at temperatures of 40° C. or less. The $KV_{40}$ is preferably below 40 $mm^2/s$, more preferably 20 to 40 $mm^2/s$. The $KV_{40}$ is the kinematic viscosity at 40° C. and may be measured according to ASTM D445.

The lubricating oil formulations preferably have a viscosity index of more than 180, more preferably of more than 200, most preferably of more than 210. The viscosity index may be measured according to ASTM D2270.

The lubricating oil formulation according to the present invention is preferably a transmission fluid or a lubricating engine oil formulation.

The lubricating oil formulations according to the invention may also contain, as component (iii), further additives selected from the group consisting of friction modifiers, dispersants, defoamers, detergents, antioxidants, antiwear additives, extreme pressure additives, anticorrosion additives, dyes and mixtures thereof.

Appropriate dispersants include poly(isobutylene) derivatives, for example poly(isobutylene)succinimides (PIBSIs), including borated PIBSIs; and ethylene-propylene oligomers having N/O functionalities.

Dispersants (including borated dispersants) are preferably used in an amount of 0 to 5% by weight, based on the total amount of the lubricant composition.

Suitable defoamers are silicone oils, fluorosilicone oils, fluoroalkyl ethers.

The defoaming agent is preferably used in an amount of 0.005 to 0.1% by weight, based on the total amount of the lubricant composition.

The preferred detergents include metal-containing compounds, for example phenoxides; salicylates; thiophosphonates, especially thiopyrophosphonates, thiophosphonates and phosphonates; sulfonates and carbonates. As metal, these compounds may contain especially calcium, magnesium and barium. These compounds may preferably be used in neutral or overbased form.

Detergents are preferably used in an amount of 0.2 to 1% by weight, based on the total amount of the lubricant composition.

The suitable antioxidants include, for example, phenol-based antioxidants and amine-based antioxidants.

Phenol-based antioxidants include, for example, octadecyl-3-(3,5-di-tert-butyl-4-hydroxyphenyl)propionate: 4,4'-methylenebis(2,6-di-tert-butylphenol); 4,4'-bis(2,6-di-t-butylphenol); 4,4'-bis(2-methyl-6-t-butylphenol); 2,2'-methylenebis(4-ethyl-6-t-butylphenol); 2,2'-methylenebis(4-methyl-6-t-butyl phenol); 4,4'-butylidenebis(3-methyl-6-t-butylphenol); 4,4'-isopropylidenebis(2,6-di-t-butylphenol); 2,2'-methylenebis(4-methyl-6-nonylphenol); 2,2'-isobutylidenebis(4,6-dimethylphenol); 2,2'-methylenebis(4-methyl-6-cyclohexylphenol); 2,6-di-t-butyl-4-methylphenol; 2,6-dl-t-butyl-4-ethyl-phenol; 2,4-dimethyl-6-t-butylphenol; 2,6-dl-t-amyl-p-cresol; 2,6-di-t-butyl-4-(N,N'-dimethylaminomethylphenol); 4,4'-thiobis(2-methyl-6-t-butylphenol); 4,4'-thiobis(3-methyl-6-t-butylphenol); 2,2'-thiobis(4-methyl-6-t-butylphenol); bis(3-methyl-4-hydroxy-5-t-butylbenzyl) sulfide; bis(3,5-di-t-butyl-4-hydroxybenzyl)sulfide; n-octyl-3-(4-hydroxy-3,5-di-t-butylphenyl)propionate; n-octadecyl-3-(4-hydroxy-3,5-dl-t-butylphenyl)propionate; 2,2'-thio[diethyl-bis-3-(3,5-dl-t-butyl-4-hydroxyphenyl)propionate]. Of those, especially preferred are bis-phenol-based antioxidants and ester group containing phenol-based antioxidants.

The amine-based antioxidants include, for example, monoalkykliphenylamines such as monooctyldiphenylamine, monononyldiphenylamine, dialkyldiphenylamines such as 4,4'-dibutyldiphenylamine, 4,4'-dipentyldiphe nylamine, 4,4'-dihexyldiphenylamine, 4,4'-diheptyldiphenylamine, 4,4'-dioctyldiphenylamine, 4,4'-dinonyldiphenylamine; polyalkyldiphenylamines such as tetrabutyldiphenylamine, tetrahexyldiphenylamine, tetraoctyldiphenylamine, tetranonyldiphenylamine; naphthylamines, concretely alpha-naphthylamine, phenyl-alpha-naphthylamine and further alkyl-substituted phenyl-alpha-naphthylamines such as butylphenyl-alpha-naphthylamine, pentylphenyl-alpha-naphthylamine, hexylphenyl-alpha-naphthylamine, heptylphenyl-alpha-naphthylamine, octylphenyl-alpha-naphthylamine, nonylphenyl-alpha-naphthylamine. Of those, diphenylamines are preferred to naphthylamines, from the viewpoint of the antioxidation effect thereof.

Suitable antioxidants may further be selected from the group consisting of compounds containing sulfur and phosphorus, for example metal dithiophosphates, for example zinc dithiophosphates (ZnDTPs), "OOS triesters"=reaction products of dithiophosphoric acid with activated double bonds from olefins, cyclopentadiene, norbornadiene, α-pinene, polybutene, acrylic esters, maleic esters (ashless on combustion); organosulfur compounds, for example dialkyl sulfides, diaryl sulfides, polysulfides, modified thiols, thiophene derivatives, xanthates, thioglycols, thioaldehydes, sulfur-containing carboxylic acids; heterocyclic sulfur/nitrogen compounds, especially dialkyldimercaptothiadiazoles, 2-mercaptobenzimidazoles: zinc bis(dialkyldithiocarbamate) and methylene bis(dialkyklithiocarbamate); organophosphorus compounds, for example triaryl and trialkyl phosphites: organocopper compounds and overbased calcium- and magnesium-based phenoxides and salicylates.

Antioxidants are used in an amount of 0 to 15% by weight, preferably 0.1 to 10% by weight, more preferably 0.5 to 5% by weight, based on the total amount of the lubricant composition.

The preferred antiwear and extreme pressure additives include sulfur-containing compounds such as zinc dithiophosphate, zinc di-$C_{3-12}$-alkyldithiophosphates (ZnDTPs), zinc phosphate, zinc dithiocarbamate, molybdenum dithiocarbamate, molybdenum dithiophosphate, disulfides, sulfurized olefins, sulfurized oils and fats, sulfurized esters, thiocarbonates, thiocarbamates, polysulfides; phosphorus-containing compounds such as phosphites, phosphates, for example trialkyl phosphates, triaryl phosphates, e.g. tricresyl phosphate, amine-neutralized mono- and dialkyl phosphates, ethoxylated mono- and dialkyl phosphates, phosphonates, phosphines, amine salts or metal salts of those compounds: sulfur and phosphorus-containing anti-wear agents such as thiophosphites, thiophosphates, thiophosphonates, amine salts or metal salts of those compounds.

The antiwear agent may be present in an amount of 0 to 3% by weight, preferably 0.1 to 1.5% by weight, more preferably 0.5 to 0.9% by weight, based on the total amount of the lubricant composition.

The preferred friction modifiers may include mechanically active compounds, for example molybdenum disulfide, graphite (including fluorinated graphite), poly(trifluorethylene), polyamide, polyimide; compounds which form adsorption layers, for example long-chain carboxylic acids, fatty acid esters, ethers, alcohols, amines, amides, imides; compounds which from layers through tribochemical reactions, for example saturated fatty acids, phosphoric acid and thiophosphoric esters, xanthogenates, sulphurized fatty acids; compounds which form polymer-like layers, for example ethoxylated dicarboxylic acid partial esters, dialkyl phthalates, methacrylates, unsaturated fatty acids, sulphurized olefins and organometallic compounds, for example molybdenum compounds (molybdenum dithiophosphates and molybdenum dithiocarbamates MoDTC) and their combinations with ZnDTPs, copper-containing organic compounds.

Some of the compounds listed above may fulfil multiple functions. ZnDTP, for example, is primarily an antiwear additive and extreme pressure additive, but also has the character of an antioxidant and corrosion inhibitor (here: metal passivator/deactivator).

The above-detailed additives are described in detail, inter alia, in T. Mang, W. Dresel (eds.): "Lubricants and Lubrication", Wiley-VCH, Weinheim 2001; R. M. Mortier, S. T. Orszulik (eds.): "Chemistry and Technology of Lubricants".

Preferably, the total concentration of the one or more additives (iii) is up to 20% by weight, more preferably 0.05% to 15% by weight, more preferably 5% to 15% by weight, based on the total weight of the lubricating oil formulation.

Preferably, the amounts of (i) to (iii) sum up from 90 to 100% by weight, more preferably sum up from 95 to 100% by weight, even more preferably sum up to 100% by weight, based on the total weight of the lubricating oil formulation.

Experimental Part

The invention is further illustrated in detail hereinafter with reference to examples and comparative examples, without any intention to limit the scope of the present invention.

Abbreviations $C_1$ AMA $C_1$-alkyl methacrylate=methyl methacrylate (MMA)

$C_4$ AMA $C_4$-alkyl methacrylate=n-butyl methacrylate $C_{12/14}$ AMA n-$C_{12/14}$-alkyl methacrylates $C_{16/18}$ AMA n-$C_{16/18}$-alkyl methacrylates CTA chain transfer agent DDM dodecyl mercaptan $f_{branch}$ degree of branching initiator tert-butylperoxy-2-ethylhexanoate $KV_{40}$ kinematic viscosity @40° C. measured according to ASTM D7042

$KV_{100}$ kinematic viscosity @100° C., measured according to ASTM D7042

MA-1 macroalcohol of hydrogenated polybutadiene with methacrylate functionality ($M_n$=2,000 g/mol)

MA-2 macroalcohol of hydrogenated polybutadiene with methacrylate functionality ($M_n$=4,750 g/mol)

MM-1 macromonomer of hydrogenated polybutadiene with methacrylate functionality ($M_n$=2,000 g/mol)

MM-2 macromonomer of hydrogenated polybutadiene with methacrylate functionality ($M_n$=4,750 g/mol)

$M_n$ number-average molecular weight $M_w$ weight-average molecular weight

NB3020 Nexbase®3020, Group III base oil from Neste with a $KV_{100}$ of 2.2 cSt

NB3043 Nexbase®3043, Group III base oil from Neste with a $KV_{100}$ of 4.3 cSt

Base oil (C) mixture of commercially available API base oils Yubase 3 (API group II base oil) and Yubase 4 plus (API group III base oil) by weight ratio of 70/30, from SK Lubricants Co. Ltd., with a $KV_{100}$ of 3.1 and 4.2 cSt, respectively OEM original equipment manufacturer PDI polydispersity index, molecular weight distribution calculated via $M_w/M_n$ Sty Styrene VI viscosity index, measured according to ASTM D2270

Test Methods

The polymers according to the present invention and comparative examples were characterized with respect to their molecular weight and PDI.

In the present invention, the weight-average molecular weights ($M_w$) of the polymers (pour point depressant (P) and viscosity index improver (V)) are determined by gel permeation chromatography (GPC) using polymethylmethacrylate calibration standards using the following measurement conditions:

Eluent: tetrahydrofuran (THF)

Operation temperature: 40° C.

Column set: the column set consists of one pre-column (PSS-SDV 100 Å 10 μm 8.0×50 mm), and three columns (2×PSS-SDV Linear XL 10 μm 8.0×300 mm, 1×PSS-SDV 100 Å 10 μm 8.0×300 mm), all columns with an average particle size of 10 μm (PSS Standards Service GmbH, Mainz, Germany)

Flow rate: 1 mL/min

Injected volume: 100 μL

Instrument: Shodex GPC101 consisting of an autosampler, pump and column oven

Detection device: a refractive index detector from Shodex.

The number-average molecular weight ($M_n$) of the macromonomer is determined by gel permeation chromatography (GPC) using polybutadiene calibration standards (PSS Standards Service GmbH, Mainz, Germany) according to DIN 55672-1 using the following measurement conditions:

Eluent: tetrahydrofuran (THF)

Operation temperature: 35° C.

Column set: the column set consists of one pre-column (PSS-SDV; 10μ; 8×50 mm); four PSS-SDV columns with a size of 300×8 mm and an average particle size of 10 μm (SDV-LXL, SDV-LinL, 2 columns SDV 100 Å (PSS Standards Service GmbH, Mainz, Germany)); and one solvent-peak separation column with a size of 8×100 mm (KF-800D from the company Shodex)

Flow rate: 1 mL/min

Injected volume: 100 μL

Instrument: Agilent 1100 series consisting of an autosampler, pump and column oven Detection device: a refractive index detector from Agilent 1100 series The additive compositions (A) including the polymers (P) and (V) according to the present invention and comparative examples were characterized with respect to their viscosity index (VI) according to ASTM D 2270, as well as their kinematic viscosity at 40° C. ($KV_{40}$) and 100° C. ($KV_{100}$) according to ASTM D7042.

A storage test was done at 25° C. for 1 week after preparing additive composition consisting of blending (V) and (P) and determined by visual observation. "Good" means the additive composition shows clear appearance after the storage. "Bad" means the additive composition shows hazy appearance which means heterogeneous and has a risk or separation for the long-term storage. In general, the additive composition is stored by drum or bulk tank. In case the additive composition is separated into two phases (VII and PPD) during storage, the fluid containing the additive composition does not provide proper viscosity properties because proper dosage of VII and PPD are not charged in the fluid due to separation.

Synthesis of Macroalcohols (Hydroxylated Hydrogenated Polybutadiene) MA-1 and MA-2

The macroalcohol was synthesized by anionic polymerization of 1,3-butadiene with butyllithium at 20-45° C. On attainment of the desired degree of polymerization, the reaction was stopped by adding propylene oxide and lithium was removed by precipitation with methanol. Subsequently, the polymer was hydrogenated under a hydrogen atmosphere in the presence of a noble metal catalyst at up to 140° C. and 200 bar pressure. After the hydrogenation had ended, the noble metal catalyst was removed, and organic solvent was drawn off under reduced pressure. Finally, MA-2 was diluted with NB3020 to a polymer content of 70% by weight. MA-1 was kept 100%.

Table 2 summarizes the characterization data of MA-1 and MA-2.

TABLE 2

Characterization data of used macromonomers.

| | $M_n$ [g/mol] | Hydrogenation level [%] | OH functionality [%] |
|---|---|---|---|
| MA-1 | 2,000 | >99 | >98 |
| MA-2 | 4,750 | >99 | >98 |

Synthesis of Macromonomers MM-1 and MM-2

In a 2 L stirred apparatus equipped with saber stirrer, air inlet tube, thermocouple with controller, heating mantle, column having a random packing of 3 mm wire spirals, vapor divider, top thermometer, reflux condenser and substrate cooler, 1000 g of the above-described macroalcohols are dissolved in methyl methacrylate (MMA) by stirring at 60° C. Added to the solution are 20 ppm of 2,2,6,6-tetramethylpiperidin-1-oxyl radical and 200 ppm of hydroquinone monomethyl ether. After heating to MMA reflux (bottom temperature about 110° C.) while passing air through for stabilization, about 20 mL of MMA are distilled off for azeotropic drying. After coifing to 95° C., $LiOCH_3$ is added and the mixture is heated back to reflux. After the reaction time of about 1 hour, the top temperature has fallen to approximately 64° C. because of methanol formation. The methanol/MMA azeotrope formed, is distilled off constantly until a constant top temperature of about 100° C. is established again. At this temperature, the mixture is left to react for a further hour. For further workup, the bulk of MMA is drawn off under reduced pressure. Insoluble catalyst residues are removed by pressure filtration (Seitz T1000 depth filter).

Table 3 summarizes the macroalcohol, MMA and $LiOCH_3$ amounts used for the synthesis of macromonomers MM-1 and MM-2.

TABLE 3

Macroalcohols, MMA and catalyst amounts for the transesterification of the macromonomers.

| Macromonomer | Macroalcohol | amount MMA [g] | amount $LiOCH_3$ [g] |
|---|---|---|---|
| MM-1 | MA-1 | 500 | 1.5 |
| MM-2 | MA-2 | 450 | 0.3 |

Because of their high molecular weight, the hydroxylated hydrogenated polybutadienes can also be referred to as macroalcohols in the context of this invention. The corresponding esters of (meth)acrylic acid can also be referred to as macromonomers in the context of this invention (monomer a)).

Synthesis of Polymers According to the Present Invention

Working Example Viscosity Index Improver (V-1)

The monomer mixture whose composition is shown in Table 5 is diluted with a 1.3/98.7 mixture of Nexbase 3020 and Hydroseal G232 H, so that the concentration of monomers in oil is 60 wt %. An apparatus with 4-neck flask and precision glass saber stirrer is initially charged with 50 wt % of the reaction mixture as prepared above. After heating to 90° C. under nitrogen, 0.18 wt % (relative to the amount of monomers) of 2,2-bis(tert-butylperoxy)butane initiator is added to the reaction mixture to start the reaction. The same amount of initiator and Hydroseal G232 H are added to the other 50% of the reaction mixture, so that the concentration of monomers in oil is 40 wt %, which is added constantly to the flask over three hours at 90° C. The reaction is maintained at 90° C. and 1 hour after the reaction mixture dosing, 0.2 wt % (relative to the amount of monomers) of 2,2-bis(tert-butylperoxy)butane are added. The reaction mixture is stirred at 90° C. for additional 2 hours and 0.2% (relative to the amount of monomers) of 2,2-bis(tert-butylperoxy)butane are added, and then diluted to a 35 wt % solution of polymer in oil with Hydroseal G232 H to obtain the final VII (V-1).

Working Example Viscosity Index Improver (V-2)

The monomer mixture whose composition is shown in Table 5 is diluted with a 15.52/65.45/19.03 mixture of Nexbase 3020, Hydroseal G232 H and Nexbase 3043, so that the concentration of monomers in oil is 60 wt %. An apparatus with 4-neck flask and precision glass saber stirrer is initially charged with 50 wt % of the reaction mixture as prepared above. After heating to 90° C. under nitrogen, 0.09 wt % (relative to the amount of monomers) of 2,2-bis(tert-butylperoxy)butane initiator is added to the reaction mixture to start the reaction. 0.29% (relative to the amount of monomers) of initiator is added to the other 50% of the reaction mixture, which is added constantly to the flask over three hours at 90° C. The reaction is maintained at 90° C. and 1 hour after the reaction mixture dosing, 0.18 wt % (relative to the amount of monomers) of 2,2-bis(tert-butylperoxy) butane and Nexbase 3043 are constantly added to the flask over three hours, so that the product solid after end of the feed is 39.8 wt %. The reaction mixture is stirred at 90° C. for additional 2 hours and 0.18% (relative to the amount of monomers) of 2,2-bis(tert-butylperoxy)butane is added, and then diluted to a 25 wt % solution or polymer in oil with Nexbase 3043 to obtain the final VII (V-2).

Working Example Pour Point Depressants P-1 to P-6 and Comparative Example Hour Point Depressants P-7* and P-8*

A 4-neck glass round bottom flask equipped with condenser, stirrer and thermocouple was initially charged with a monomer mixture consisting of monomers and DDM as shown in Table 4 and Hydroseal G232 H, so that the concentration of monomers in oil is 97.7 wt %. The monomer mixture was heated to 120° C. under nitrogen.

Preparation of initiator solution: 0.2 wt % (relative to the total weight of monomers) of 2,2-bis(tert-butylperoxy)butane initiator was diluted with Hydroseal G232 H, so that the concentration or the initiator in the oil is 20 wt %.

10% by weight of the total initiator solution was added to the flask over 45 minutes. Then 20% by weight of the total initiator feed mixture was added to the flask over 45 minutes. After that, reaction temperature was increased to 105° C., then the remaining initiator feed mixture was added to the flask over 30 minutes. The reaction mixture was held at 105° C. for 60 minutes, then Hydroseal G232 H was added, so that product solid is 56.66 wt %, and stirred at 105° C. for 60 minutes to obtain final PPD (working examples: P-1 to P-6 and comparative example: P-7* and P-8*).

Table 4 below shows the reaction mixtures used to prepare the working and comparative examples. The monomer components add up to 100%. The amount of chain transfer agent is given relative to the total amount of monomers. Weight-average molecular weight ($M_w$) are also shown in Table 4.

Above mentioned PPDs (P-1 to P-6, P-7* and P-8*) and VIIs (V-1 and V-2) were mixed and additive composition (working examples: Ex. A-1 to Ex. A-10 and comparative examples: Comp. A-1* to Comp. A-3*) were obtained. The blend ratio, polymer content and appearance (storage test) are shown in Table 5 and Table 6 below.

The additive composition working examples (Ex. A-1 to Ex. A-10) showed clear appearance after storage test, which means that the combination or vii and PPD according to the present invention leads to additive compositions with good compatibility and good storage performance. In contrast, the comparative additive compositions (Comp. A-1* to Comp. A-3*) showed hazy appearance due to bad compatibility of VII component and PPD component.

TABLE 4

Polymers: Reaction mixtures used to prepare working examples and comparative examples.

| | MM-1 [wt %] | MM-2 [wt %] | $C_{12/14}$ AMA [wt %] | $C_{16/18}$ AMA [wt %] | $C_4$ AMA [wt %] | $C_1$ AMA [wt %] | Sty [wt %] | $f_{branch}$ | CTA [wt %] | $M_w$/1000 [g/mol] | PDI | Polymer solid content, [wt %] |
|---|---|---|---|---|---|---|---|---|---|---|---|---|
| V-1 | 27.5 | — | 0.1 | 5.0 | 54.5 | 12.7 | 0.2 | 2.5 | 0.58 | 134 | 3.5 | 35.0 |
| V-2 | — | 24.0 | 10.1 | — | 64.4 | 0.2 | 1.3 | 1.0 | — | 375 | 4.8 | 25.0 |
| P-1 | — | — | 45.0 | 30.0 | — | 25.0 | — | — | 1.9 | 26 | 2.2 | 56.7 |
| P-2 | — | — | 45.0 | 30.0 | — | 25.0 | — | — | 2.9 | 19 | 2.2 | 56.7 |
| P-3 | — | — | 35.0 | 35.0 | — | 30.0 | — | — | 1.1 | 45 | 2.2 | 56.7 |
| P-4 | — | — | 40.0 | 35.0 | — | 25.0 | — | — | 1.9 | 27 | 2.3 | 56.7 |
| P-5 | — | — | 35.0 | 40.0 | — | 25.0 | — | — | 1.9 | 28 | 2.1 | 56.7 |
| P-6 | — | — | 30.0 | 45.0 | — | 25.0 | — | — | 1.9 | 28 | 2.3 | 56.7 |
| P-7* | — | — | 94.0 | 6.0 | — | — | — | — | 0.44 | 78 | 2.5 | 56.7 |
| P-8* | — | — | 94.0 | 6.0 | — | — | — | — | 0.29 | 113 | 2.4 | 56.7 |

TABLE 5

Inventive additive compositions (A): Blend ratio, appearance and solid content of additive compositions (working examples A-1 to Ex. A-10).

| | Examples | A-1 | A-2 | A-3 | A-4 | A-5 | A-6 | A-7 | A-8 | A-9 | A-10 |
|---|---|---|---|---|---|---|---|---|---|---|---|
| Blend ratio, % by weight | V-1 | 94.69 | 94.69 | 94.69 | — | 98.89 | — | 94.68 | 94.68 | 94.68 | — |
| | V-2 | — | — | — | 90.2 | — | 80.0 | — | — | — | 98.77 |
| | P-1 | 5.31 | — | — | 9.8 | 1.11 | 20.0 | — | — | — | 1.23 |
| | P-2 | — | 5.31 | — | — | — | — | — | — | — | — |
| | P-3 | — | — | 5.31 | — | — | — | — | — | — | — |
| | P-4 | — | — | — | — | — | — | 5.32 | — | — | — |
| | P-5 | — | — | — | — | — | — | — | 5.32 | — | — |
| | P-6 | — | — | — | — | — | — | — | — | 5.32 | — |
| Solid polymer content in additive composition, wt % | | 36.1 | 36.1 | 36.1 | 28.1 | 35.2 | 31.3 | 36.2 | 36.2 | 36.2 | 25.4 |
| Storage test | | Good | Good | Good | Good | Good | Good | Good | Good | Good | Good |

TABLE 6

Comparative additive compositions: Blend ratio, appearance and solid content on additive composition (Comp. A-1* to Comp. A-3*)

| | Comparative examples | Comp. A-1* | Comp. A-2* | Comp. A-3* |
|---|---|---|---|---|
| Blend ratio, wt % | V-1 | 94.39 | — | — |
| | V-2 | — | 89.22 | 80.0 |
| | P-7* | 5.61 | — | 20.0 |
| | P-8* | — | 10.78 | — |
| Solid polymer content of polymers (V) and (P) in the additive composition, wt % | | 36.2 | 28.4 | 31.3 |
| Storage test | | bad | bad | bad |

*comparative examples

Evaluation of Additive Composition Candidates

The additive compositions A-1 to A-4 and A-6, according to the present invention, as well as the comparative additive compositions Comp. A-1* to Comp. A-3*, were formulated with ATF package and base oil (C) according to a blend ratio as shown in Table 7, and $KV_{100}$, $KV_{40}$, VI and BF-40 were evaluated. The inventive lubricating oil formulations Ex. F and comparative lubricating oil formulations Comp. F and their viscometric performance are shown in Table 7 below.

To demonstrate the improved effect in viscosity index when using the additive composition of the present invention in a lubricating oil formulation, $KV_{100}$ of all fluids was adjusted to 4.9-5.0 cSt.

The lubricating oil formulations Ex. F-1 to Ex. F-3 and Comp. F-1* all include the same VII component V-1. While maintaining proper low temperature properties (BF-40), the formulations according to the invention (Examples F-1 to Ex. F-3) also show a much higher viscosity index compared with the comparative formulation Comp. F-1*, with 3 to 7 point difference in the VI value.

The lubricating oil formulations Ex. F-4 to Ex. F-5 of the invention, as well as the comparative lubricating oil formulations Comp. F-2* and Comp. F-3*, all include the same VII component V-2. While maintaining proper low temperature properties (BF-40), the formulations according to the invention (Examples F-4 to Ex. F-5) also show a much higher viscosity index compared with the comparative formulations Comp. F-2* and Comp. F-3*, with 6 to 8 point difference in the VI value.

TABLE 7

Lubricating oil formulations: Viscometric performance of the working examples (F) and comparative examples (Comp. F)

| | Additive Composition (A) | VII Component (V) | PPD Component (P) | Ex. F-1 | Ex. F-2 | Ex. F-3 | Ex. F-4 | Ex. F-5 | Comp. F-1* | Comp. F-2* | Comp. F-3* |
|---|---|---|---|---|---|---|---|---|---|---|---|
| Blend ratio, wt % | A-1 | (V-1) | (P-1) | 9.42 | — | — | — | — | — | — | — |
| | A-2 | (V-1) | (P-4) | — | 9.42 | — | — | — | — | — | — |
| | A-3 | (V-1) | (P-5) | — | — | 9.42 | — | — | — | — | — |
| | A-4 | (V-2) | (P-1) | — | — | — | 5.1 | — | — | — | — |
| | A-6 | (V-2) | (P-1) | — | — | — | — | 5.43 | — | — | — |
| | Comp. A-1* | (V-1) | (P-7*) | — | — | — | — | — | 8.91 | — | — |
| | Comp. A-2* | (V-2) | (P-8*) | — | — | — | — | — | — | 4.64 | — |
| | Comp. A-3* | (V-2) | (P-7*) | — | — | — | — | — | — | — | 4.79 |
| | | Base oil (C) | | 83.33 | 83.33 | 83.33 | 87.65 | 87.32 | 83.84 | 88.11 | 87.96 |
| | | DI Package | | 7.25 | 7.25 | 7.25 | 7.25 | 7.25 | 7.25 | 7.25 | 7.25 |
| | | $KV_{100}$ | | 4.936 | 4.950 | 4.976 | 4.920 | 4.953 | 4.950 | 4.927 | 4.954 |
| | | $KV_{40}$ | | 18.05 | 18.04 | 18.07 | 18.34 | 18.47 | 18.29 | 18.67 | 18.88 |
| | | VI | | 222 | 224 | 226 | 215 | 215 | 219 | 209 | 207 |
| | | BF-40 | | 3400 | 3400 | 3400 | 4000 | 4600 | 3400 | 4000 | 4600 |

*comparative examples

The invention claimed is:

1. An additive composition (A), comprising:

a viscosity index improver (V), and a pour point depressant (P), wherein the viscosity index improver (V) is a polymer having a weight average molecular weight (Mw) of 100,000 to 1,000,000 g/mol and is obtainable by polymerizing a viscosity index improver monomer composition comprising:

a) 10 to 30% by weight of one or more polybutadiene-based macromonomers a) having a number-average molecular weight of 500 to 10,000 g/mol, based on a total weight of the viscosity index improver monomer composition, b) 50 to 70% by weight of one or more monomers selected from the group consisting of methyl(meth)acrylate, butyl(meth)acrylate, a styrene monomer having from 8 to 17 carbon atoms, a substituted styrene monomer having 8 to 17 carbon atoms and having an alkyl substituent in a side chain, and a mixture thereof, based on the total weight of the viscosity index improver monomer composition, c) 1 to 15% by weight of one or more monomers selected from a linear $C_7$-$C_{30}$ alkyl(meth)acrylate, a branched $C_7$-$C_{30}$ alkyl(meth)acrylate, and a mixture thereof, based on the total weight of the viscosity index improver monomer composition, wherein the pour point depressant (P) is a polymer having a weight average molecular weight (Mw) of 10,000 to 60,000 g/mol and is obtainable by polymerizing a pour point depressant monomer composition comprising:

e) 20 to 35% by weight of one or more monomers selected from the group consisting of a linear $C_1$-$C_6$ alkyl(meth) acrylate, a branched $C_1$-$C_6$ alkyl(meth)acrylate, and a mixture thereof, based on a total weight of the pour point depressant monomer composition, f) 20 to 75% by weight of one or more monomers selected from the group consisting of a linear $C_7$-$C_{15}$ alkyl (meth)acrylate and a branched $C_7$-$C_{15}$ alkyl(meth)acrylate, based on the total weight of the pour point depressant monomer composition, g) 5 to 60% by weight of one or more monomers selected from the group consisting of a linear $C_{16}$-$C_{24}$ alkyl (meth)acrylate and a branched $C_{16}$-$C_{24}$ alkyl(meth) acrylate, based on the total weight of the pour point depressant monomer composition, and wherein a weight ratio of (V) to (P) is 99:1 to 80:20, based on a total solid polymer content of (V) and (P) in the additive composition.

2. The additive composition (A) according to claim 1, wherein the viscosity index improver (V) has a weight-average molecular weight from 100,000 to 600,000 g/mol.

3. The additive composition (A) according to claim 1, wherein the one or more polybutadiene-based macromonomers a) has a number-average molecular weight of 1,000 to 6,000 g/mol.

4. The additive composition (A) according to claim 1, wherein the one or more monomers e) is selected from the group consisting of methyl (meth)acrylate, butyl (meth) acrylate, and a mixture thereof.

5. The additive composition (A) according to claim 1, wherein the amount of the one or more monomers f) is 20 to 60% by weight, based on the total weight of the pour point depressant monomer composition.

6. The additive composition (A) according to claim 1, wherein the amount of the one or more monomers g) is 20 to 50% by weight, based on the total weight of the pour point depressant monomer composition.

7. The additive composition (A) according to claim 1, wherein the amounts of the one or more monomers e), the one or more monomers f), and the one or more monomers g) in the pour point depressant monomer composition sum up to 95 to 100% by weight, based on the total weight of the pour point depressant monomer composition.

8. The additive composition (A) according to claim 1, wherein the amount of the one or more monomers b) is 55 to 70% by weight, based on the total weight of the viscosity index improver monomer composition.

9. The additive composition (A) according to claim 1, wherein the one or more monomers c) is selected from the group consisting of a linear $C_{12-14}$ alkyl methacrylate, a linear $C_{16-18}$ alkyl methacrylate, and a mixture thereof.

10. The additive composition (A) according to claim 1, wherein the viscosity index improver monomer composition further comprises 0 to 20% by weight of one or more monomers d) selected from the group consisting of a (meth) acrylate of an ether alcohol, an aminoalkyl (meth)acrylate, an aminoalkyl (meth)acrylamide, and a mixture thereof.

11. The additive composition (A) according to claim 10, wherein the amounts of the one or more polybutadiene-based macromonomers a), the one or more monomers b), the one or more monomers c), and the one or more monomers d) in the viscosity index improver monomer composition sum up to 95 to 100% by weight, based on the total weight of the viscosity index improver monomer composition.

12. The additive composition (A) according to claim 1, wherein the viscosity index improver (V) has a weight-average molecular weight (Mw) from 100,000 to 500,000 g/mol.

13. A method for preparing the additive composition (A) as defined in claim 1, the method comprising:

providing the viscosity index improver monomer composition and initiating radical polymerization in the viscosity index improver monomer composition, to obtain the viscosity index improver (V), providing the pour point depressant monomer composition and initiating radical polymerization in the pour point depressant monomer composition, to obtain the pour point depressant (P), mixing the viscosity index improver (V) with the pour point depressant (P) to provide the additive composition (A).

14. A lubricating oil formulation, comprising:

one base oil or a mixture of base oils, and the additive composition (A) as defined in claim 1.

15. A method of improving storage stability, viscosity index, and low temperature performance of a lubricating oil formulation, the method comprising:

adding the additive composition (A) as defined in claim 1 to the lubricating oil formulation.

16. The additive composition (A) according to claim 3, wherein the one or more polybutadiene-based macromonomers a) has a number-average molecular weight of 1,500 to 5,500 g/mol.

17. The additive composition (A) according to claim 4, wherein the one or more monomers e) is methyl (meth) acrylate.

18. The additive composition (A) according to claim 5, wherein the amount of the one or more monomers f) is 25 to 55% by weight, based on the total weight of the pour point depressant monomer composition.

19. The additive composition (A) according to claim 6, wherein the amount of the one or more monomers g) is 25 to 50% by weight, based on the total weight of the pour point depressant monomer composition.

20. The additive composition (A) according to claim 10, wherein the viscosity index improver monomer composition comprises 0.1 to 10% by weight of the one or more monomers d).

* * * * *